US009861246B2

(12) United States Patent
Bradbury et al.

(10) Patent No.: US 9,861,246 B2
(45) **Date of Patent: *Jan. 9, 2018**

(54) UNITARY CLEANING DEVICE HAVING ONBOARD REPLACEABLE CLEANING PAD AND ONBOARD REPLACEABLE CLEANING SOLUTION

(71) Applicant: The Procter & Gamble Company, Cincinnati, OH (US)

(72) Inventors: Glenn Allen Bradbury, Mason, OH (US); Louis Robert Zeiser, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 187 days.

This patent is subject to a terminal disclaimer.

(21) Appl. No.: 14/844,126

(22) Filed: Sep. 3, 2015

(65) Prior Publication Data

US 2017/0065139 A1 Mar. 9, 2017

(51) Int. Cl.

| | |
|---|---|
| ***A47L 13/26*** | (2006.01) |
| ***A47K 3/28*** | (2006.01) |
| ***B25G 1/10*** | (2006.01) |
| ***A47L 13/44*** | (2006.01) |

(52) U.S. Cl.

CPC ..... *A47L 13/26* (2013.01); *A47K 3/281* (2013.01); *A47L 13/44* (2013.01); *B25G 1/10* (2013.01)

(58) Field of Classification Search

CPC combination set(s) only.

See application file for complete search history.

(56) References Cited

U.S. PATENT DOCUMENTS

| | | | | |
|---|---|---|---|---|
| 1,255,053 A | | 1/1918 | Satrum et al. | |
| 2,201,260 A | * | 5/1940 | Connor | A47L 23/05 132/286 |
| 3,031,711 A | * | 5/1962 | Sam Herman | A47L 23/05 15/258 |
| 5,299,876 A | | 4/1994 | Singarella | |
| 5,502,873 A | | 4/1996 | Hogan | |
| 6,595,712 B2 | | 7/2003 | Sickler | |

(Continued)

FOREIGN PATENT DOCUMENTS

FR 1 549 529 A 12/1968

OTHER PUBLICATIONS

PCT Search Report PCT/US2016/048925; 11 Pages; Dated.

U.S. Appl. No. 14/844,236, filed Sep. 3, 2015, Glenn Allen Bradbury.

*Primary Examiner* — David Walczak

(74) *Attorney, Agent, or Firm* — Larry L. Huston

(57) ABSTRACT

A device for cleaning debris from a target surface. The device has a handle for gripping by a user, a hole in the handle which removably receives a replaceable container of cleaning solution and a flat surface which removably receives a cleaning pad. This device may be extruded from a monolithic piece of material, cut to length. The resulting device is unitary, inexpensive and durable. The pad/cleaning solution may be replaced when depleted and replaced with a new pad/cleaning solution or may simply be replaced with a new pad/cleaning solution as may be more suitable for a particular cleaning task. The device may be foam, which provides for an inexpensive construction material and convenient, ergonomic gripping.

19 Claims, 7 Drawing Sheets

(56) References Cited

U.S. PATENT DOCUMENTS

| | | | | |
|---|---|---|---|---|
| D513,102 | S | 12/2005 | Davis-Wilson et al. | |
| D522,201 | S | 5/2006 | Davis-Wilson et al. | |
| D578,720 | S | 10/2008 | Norcom et al. | |
| 7,624,469 | B2 | 12/2009 | Specht et al. | |
| 8,001,645 | B2 * | 8/2011 | Kaufman | A46B 7/04 15/114 |
| 8,277,935 | B2 | 10/2012 | Gonzales et al. | |
| 8,283,305 | B2 | 10/2012 | Gonzales et al. | |
| 8,337,110 | B2 | 12/2012 | Rees et al. | |
| 8,495,784 | B2 | 7/2013 | Steinhardt et al. | |
| 8,578,543 | B2 | 11/2013 | Policicchio et al. | |
| 8,684,619 | B2 | 4/2014 | Uchiyama et al. | |
| 8,834,055 | B2 | 9/2014 | Uchiyama et al. | |
| D727,033 | S | 4/2015 | Shafer et al. | |
| 9,044,852 | B2 | 6/2015 | Shafer et al. | |
| 9,314,146 | B2 * | 4/2016 | Gameiro | A47L 25/00 |
| 2008/0172828 | A1 | 7/2008 | Butterbaugh | |
| 2009/0301512 | A1 * | 12/2009 | Thiebaut | A45D 34/041 132/320 |
| 2013/0047358 | A1 * | 2/2013 | Shafer | A46B 11/0017 15/114 |
| 2014/0230847 | A1 | 8/2014 | Pung | |

* cited by examiner

UNITARY CLEANING DEVICE HAVING ONBOARD REPLACEABLE CLEANING PAD AND ONBOARD REPLACEABLE CLEANING SOLUTION

FIELD OF THE INVENTION

The present invention relates to cleaning devices and more particularly to cleaning devices which provide for manual use by a user and which hold a cleaning solution dispensable therefrom.

BACKGROUND OF THE INVENTION

Cleaning devices for hard surfaces are well known in the art. For example, a sponge and handle device is taught in U.S. Pat. No. 1,255,053. Such devices may be handheld or may be deployed on the end of an elongate handle, to extend the user's reach.

The device may include bristles, sponge, microfiber cloth, terry cloth, nonwoven sheets, foam and other cleaning materials, as are known in the art. But cleaning material well suited for cleaning one type of debris from a particular surface may be poorly suited for cleaning different debris from that same surface. Or that material may be poorly suited for cleaning that same debris from a different surface.

For example, one may desire to clean a shower area. The shower area may have different kinds of tile, each with different surface characteristics. The shower area may further have glass, marble, synthetic solid surface material, grout, caulk, plastic and/or ceramic surfaces. Each of these surfaces may require different treatments to optimize cleaning. For example, a cleaning material which works well on glass or ceramic might scratch a plastic surface. A cleaning material suitable for large flat surfaces may not work well for faucets or corners.

Complicating the situation are the various types of debris found on a common surface. A single surface may have soluble and insoluble debris, oil-based debris, soap scum, food stains, mold, etc. Or plural surfaces in a single area, such as, by way of non-limiting example, a shower, may have plural types of debris—further complicating the cleaning task.

Further complicating the cleaning task is the interaction between the cleaning material and any cleaning solution used therewith. Particular cleaning solutions may work more efficaciously with particular cleaning pads.

A single cleaning pad may not be optimized to clean plural types of debris from plural types of surfaces in a single cleaning task. One solution to this problem is for the user to interrupt the cleaning process mid-task and exchange the cleaning device for another. But this solution complicates the problem by requiring the purchase and storage of plural cleaning devices/pads/cleaning solutions—as well as extending the time necessary to complete the cleaning task.

An attempt to improve upon this solution is to provide a cleaning device having plural cleaning surfaces. For example, a cleaning device having dual texture bristles are known in the art. A device having a separately usable scrubber and sponge, is taught by U.S. Pat. No. 7,624,469. Some cleaning devices have renewable surfaces, as illustrated by U.S. Pat. No. 8,337,110 and by commonly assigned U.S. Pat. Nos. 8,495,784; 8,578,543; D513,102 S; D522,201 S and D578,720 S. Another device accommodates a continuous liquid flow path, as taught by U.S. Pat. No. 6,595,712. Other attempts use foam with cleaning implements, as illustrated in commonly assigned 20080172828; U.S. Pat. Nos. 8,277,935, and 8,283,305.

Yet other attempts are found in commonly assigned U.S. Pat. Nos. 5,502,873; 8,684,619; 8,834,055; 9,044,852 2014/0230847 and D 727,033. These attempts show devices advantageously having the flexibility to clean a variety of debris from a surface. But these attempts in the art can be even further simplified. Accordingly, a new solution is needed.

SUMMARY OF THE INVENTION

The invention comprises a monolithic device for cleaning debris from a target surface. The device has a sole plate which accepts a removable/replaceable cleaning surface. The device also has a replaceable, on-board supply of cleaning solution. The pad/cleaning solution may be replaced when depleted and replaced with a new pad/cleaning solution or may simply be replaced with a new pad/cleaning solution which may be more suitable for a particular cleaning task. The monolithic construction provides for ease of manufacture.

DETAILED DESCRIPTION OF THE INVENTION

Figure 1:
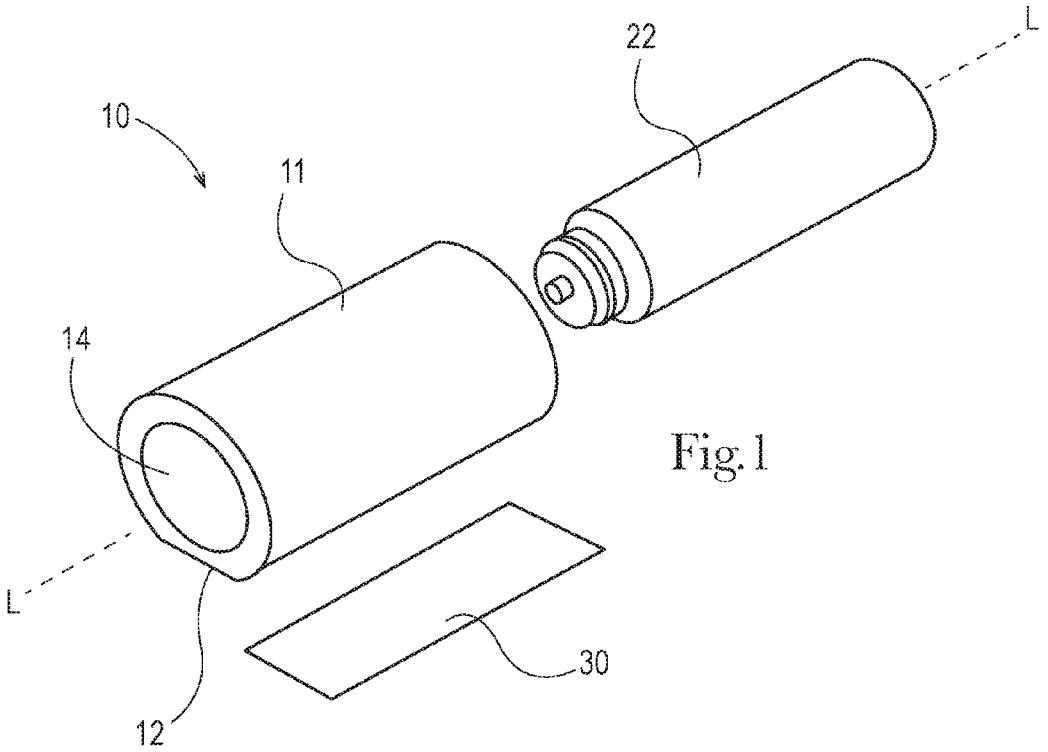
FIG. 1 is an exploded perspective view of a cleaning device according to the present invention, aerosol container and pad.
Figure 2:
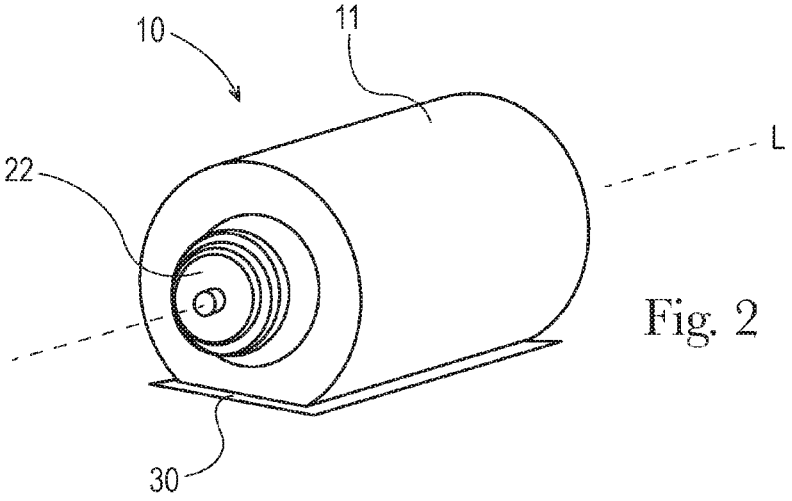
FIG. 2 is a perspective view of the device FIG. 1 having the aerosol container and pad installed.
Figure 3:
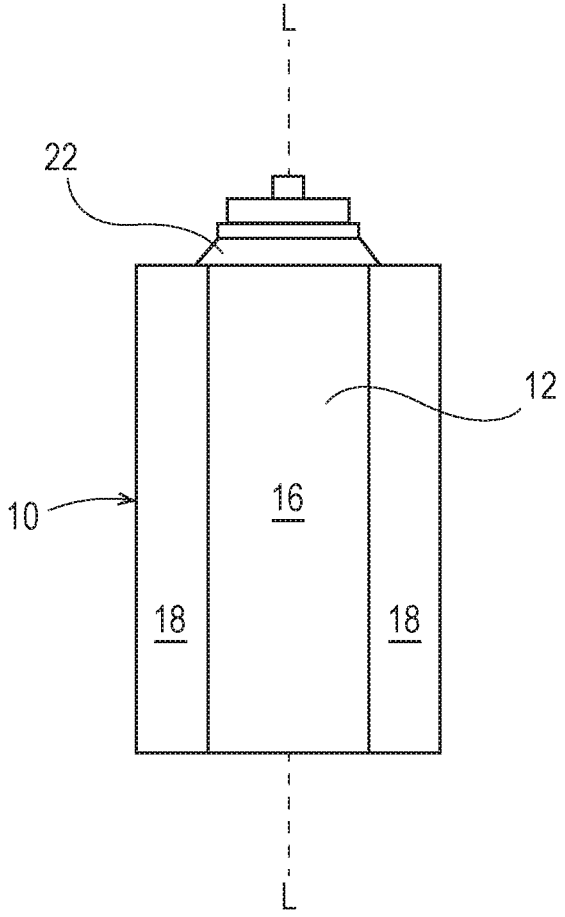
FIG. 3 is a bottom plan view of the device of FIG. 1 having the pad omitted for clarity.

Referring to FIGS. 1-3, the device 10 according to the present invention is unitary and comprises a sole plate 12, a handle 11, and a hole 14 to receive a renewable cleaning solution supply 22. The sole plate 12 has a top, or upwardly facing surface to which the handle 11 may be integrally attached. The device 10 may dispense cleaning solution therefrom directly or indirectly onto the target surface to be cleaned. The device 10 may have a longitudinal axis L-L. The device 10 may be symmetric about the longitudinal axis L-L, as shown.

The sole plate 12 further has a bottom 16 which is an outwardly facing surface. The bottom 16 of the sole plate 12 may be generally flat, including slightly concave, slightly convex and may preferably be identically flat. By generally flat it is meant that the sole plate 12 is sufficiently planar to perform cleaning tasks over a large flat surface.

The bottom 16 of the sole plate 12 may have one or more attachments disposed thereon to provide for removably attaching a pad 30 to the sole plate 12. A generally cylindrical shape is not considered to have a sole plate 12. The sole plate 12 represents a change in geometry from the handle or balance of the device 10.

In a particular configuration, a disposable pad 30 may be removably attached to the sole plate 12 using hook and loop attachment as are known in the art. Either or both of the sole plate 12 and pad 30 may have adhesive, as is known in the art. The pad 30 may be discarded at the end of the cleaning task, during the cleaning task and replaced with a fresh pad 30 if necessary, or may be replaced with a different pad 30 better suited to a particular cleaning task.

The pad 30 may comprise loop material and forms no part of the present invention, with a suitable pad 30 and attachment being described in commonly assigned publications 2014/0289985 and 2014/0289984. If desired, the replaceable pad 30 may be impregnated with cleaning solution. The cleaning solution may be complementary to or the same as the cleaning solution sprayed from the supply. The replaceable pad 30 may alternatively or additionally comprise melamine foam as is sold by the instant assignee under the name Mr. Clean® Magic Eraser®, melamine foam, as set forth in U.S. Pat. No. 7,629,043 or in commonly assigned 2009/172828 A1, now abandoned, and combinations thereof.

When the replaceable pad 30 becomes too soiled for efficacious cleaning, it may simply be removed from the sole plate 12 and discarded. A new efficacious pad 30 may then be attached to a space on the bottom 16 of the sole plate 12 and deployed for cleaning.

The hook material may be disposed on the bottom 16 of the sole plate 12 in any desired geometry to form an attachment. The hook fasteners, if selected, may particularly be molded into the bottom 16 of the sole plate 12 and the complementary loop material may be provided by the replaceable pad 30 and inherent in the material thereof.

One suitable geometry includes one or more stripes 18 of hook material. One of skill will recognize the stripes 18 may comprise adhesive material, a landing surface suitable for adhesive disposed on a pad 30, cohesive material compatible with the removable pad 30, combinations thereof, etc. Temporary attachment adhesives which can be used on either or both of the pad 30 and/or sole plate 12 include low peel force, repositionable adhesive, including pressure sensitive adhesive such as Dispomelt™ from National Starch.

Above the sole plate 12, the device 10 may further comprise a hole 14 for receiving a supply, and particularly a container 22 of the cleaning solution. The hole 14 may be disposed within the handle 11. To keep the center of gravity near the handle 11, the container 22 may be removably installed or inserted within and into the hole 14. The container 22 may removably fit into the hole 14 with a friction fit, obviating the need for a separate attachment mechanism. Preferably the friction fit is sufficient to prevent the container 22 from coming loose in use and allow for actuation of an aerosol valve by normal fingertip forces. Yet the friction fit should also allow for easy removal and insertion of a new container 22 when the currently used container 22 is depleted. An insertion force of 1 to 5 kg, and a removal force of 1 to 5 kg are believed suitable to prevent undue effort when changing a depleted container 22.

For a rigid, 45 mm diameter container 22, the hole 14 may have a diameter of about 37 to about 48 mm, and preferably be about 43 mm for a foam device 10, as described herein. This diameter is believed adequate, for such a container 22, to provide an interference fit which holds the container in place during use, yet allows for changeout to a new container 22 when depleted.

The container 22 of cleaning solution may be removably inserted into the hole 14 by sliding the container 22 into the hole 14. The container 22 may be cylindrically shaped as is common in the art, and disposed in the hole 14 generally parallel to and preferably coincident the longitudinal axis L-L. This arrangement provides improved lateral balance to the device 10, by concentrating the weight of the cleaning solution supply on the longitudinal axis. The improved lateral balance likewise improves user ergonomics. This arrangement also provides the benefit of a compact form factor and improved ergonomics, due to the weight of the container 22 and cleaning solution therein being relatively close to the sole plate 12.

The container 22 may particularly be an aerosol container 22, as is known in the art. The supply 22 of cleaning solution may have a volume of less than 250, 200, 150, or 100 ml. The device 10 may have a weight of, less than 750, 700, 650, 600, 550, 500, 450, 400, 350, 300, or 250 grams with the container 22 of cleaning solution and the pad 30 installed. Such a relatively light weight is particularly suitable for a cleaning device 10 having a handle 11 intended for single hand operation.

The sole plate 12 may be flexible and bend, compress or otherwise deform into corners and other irregular surfaces under normal usage forces. The sole plate 12 may be resiliently deformable. By resiliently deformable it is meant that at least a portion of the sole plate 12 deforms, bends or otherwise conforms to a target surface under ordinary compressive forces applied in use, and returns to substantially its original shape when the compressive force is removed.

The device 10 is preferably integral, unitary and/or monolithic. By integral it is meant that the device 10, particularly the sole plate 12, longitudinal hole 14 and handle 11 thereof, comprise a complete unit for cleaning, when complemented with removably attachable components such as a pad 30 and/or container 22. By unitary it is meant that the device 10 particularly the sole plate 12, longitudinal hole 14 and handle 11 thereof, does not comprise separable or joined components. By monolithic it is meant that the device 10, particularly the sole plate 12, longitudinal hole 14 and handle 11 thereof, is made of a single block of material, and does not have joints or seams where two parts are joined together. Thus, the device 10 may comprise a single piece of material, minimizing manufacturing complexity and cost. Of course, one of skill will understand even adding the stripes 18 still allows for simple construction and reduced cost, or omitting the stripes 18 and using a pad 30 having adhesive allows for simple, singular construction.

That is the device 10, not considering a removable component, such as a pad 30 or container 22 of cleaning solution, preferably comprises a single piece and cannot be reversibly separated into component parts and includes a sole plate 12, longitudinal hole 14 and handle 11 suitable for gripping. The device 10 is preferably homogenous, to provide for simplicity in manufacture. The device 10 may optionally further include hook material and/or related attachments, which are not integral, unitary and/or monolithic with respect to the balance of the device 10, and which may be disposed in stripes 18 or any other suitable disposition.

Particularly, the device 10 may be extruded as a single block of material, and cut into discrete units, at the desired length(s), to form individual devices 10 having the same or different length in the longitudinal direction. The hole 14 may be formed as part of the initial extrusion, obviating the need for the cost and complexity of a separate operation to form the hole 14. If desired, the device 10 may be coextruded, to comprise two or more materials, if done so in an integral fashion.

The unitary, integral, monolithic device 10 may comprise any such compliant, and preferably, resiliently deformable material, such as EVA, rubber, polypropylene, polyurethane foam and particularly polyethylene foam. A particularly useful foam may be found under CAS Number 9002-88-4. Such a foam may advantageously be considered a Non-Hazardous Chemical under 29 CFR 1910.1200.

By compliant it is meant that the device 10, and particularly the sole plate 12 and/or handle 11 thereof, as specified herein, conform[s] to the target surface and/or user's hand, respectively, under ordinary compressive forces during use. By resiliently deformable it is meant that after the device 10 conforms to a target surface, and when the deforming force is removed, the device 10 substantially returns to its original shape. It is desirable that the device 10 have enough rigidity to provide a good grip for the user and transmit cleaning forces to the target surface, yet conform to the target surface for cleaning of ridges, grooves, corners, particularly inside corners, asperities, textures, edges, etc. In one embodiment, the device 10 may have a Shore OO durometer hardness of 35 to 55.

The device 10 may have a tensile strength of at least 1500 and more particularly from 5600 to 7000 grams per square centimeter as measured according to ASTM D412, a deflection of 2400 to 3900 grams per square centimeter as measured according to ASTM D1621 and a density of 22 to 26 kgs per cubic meter. If polyethylene foam is selected, closed cell, non-absorbent foam available from Nomaco Engineered Foam Solutions of Tarboro, N.C. has been found suitable.

Alternatively the device 10 may comprise closed-cell foams of a polymer having a monomer selected from the group consisting of a urethane, a propylene, an ethylene, a butadiene, a styrene, vinyl acetate, a silicon, an ester, an acrylate, an ether, cellulose acetate, styrene, silicon, natural latex, rubber, vinylchloride, fluoroethylene, and mixtures thereof, available as Plastazote™, Evazote™, Supazote™, Propazote™ from Zotefoams plc (Croydon, UK) and FR, FM, CN or SD foam grade made with a significant fraction of hydrophobic polymer/materials.

The hook material, described above, may be separately attached to the device 10, and particularly to the sole plate 12 thereof, in a permanent, non-removable manner. Such separate attachment does not take away from the monolithic, integral construction described above. The stripes 18 of hooks, or similar attachment material complementary to the pad 30, may be added by adhesive joining, melting onto place, sonic/ultrasonic welding, etc. as are known in the art.

Figure 4:
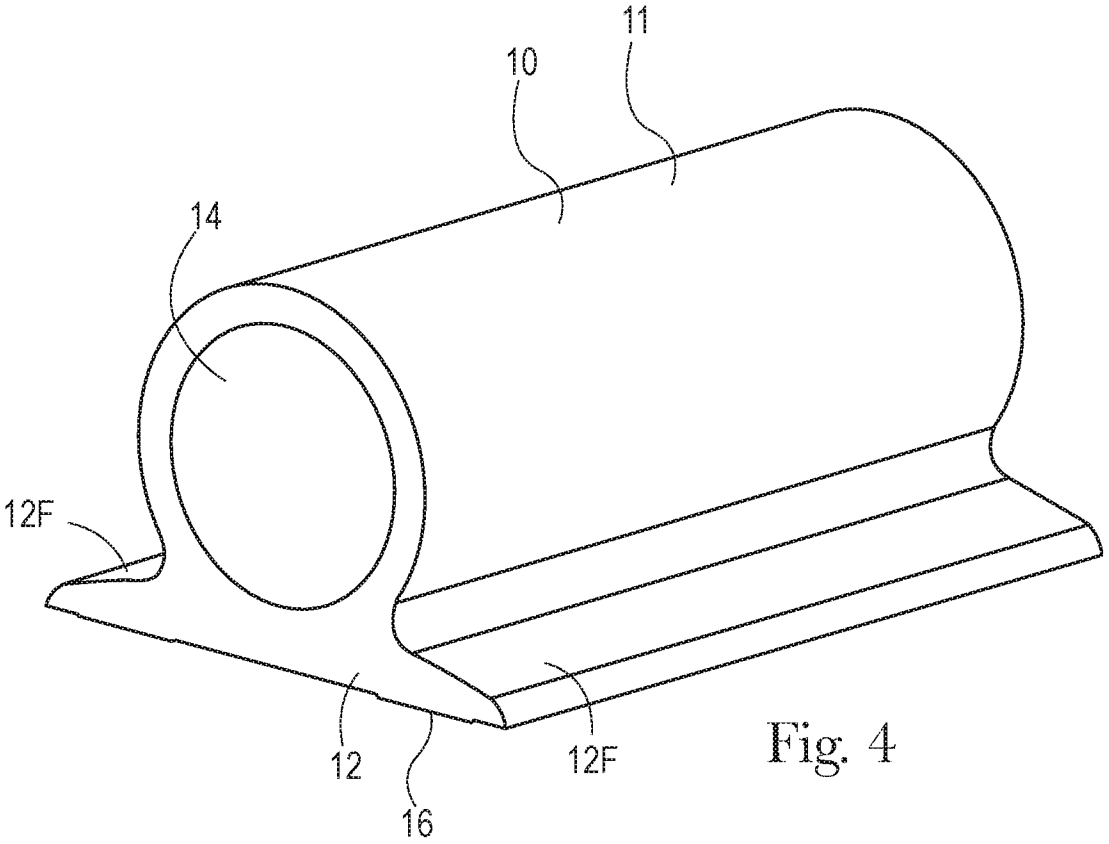
FIG. 4 is top perspective view of a first alternative embodiment cleaning device.
Figure 5:
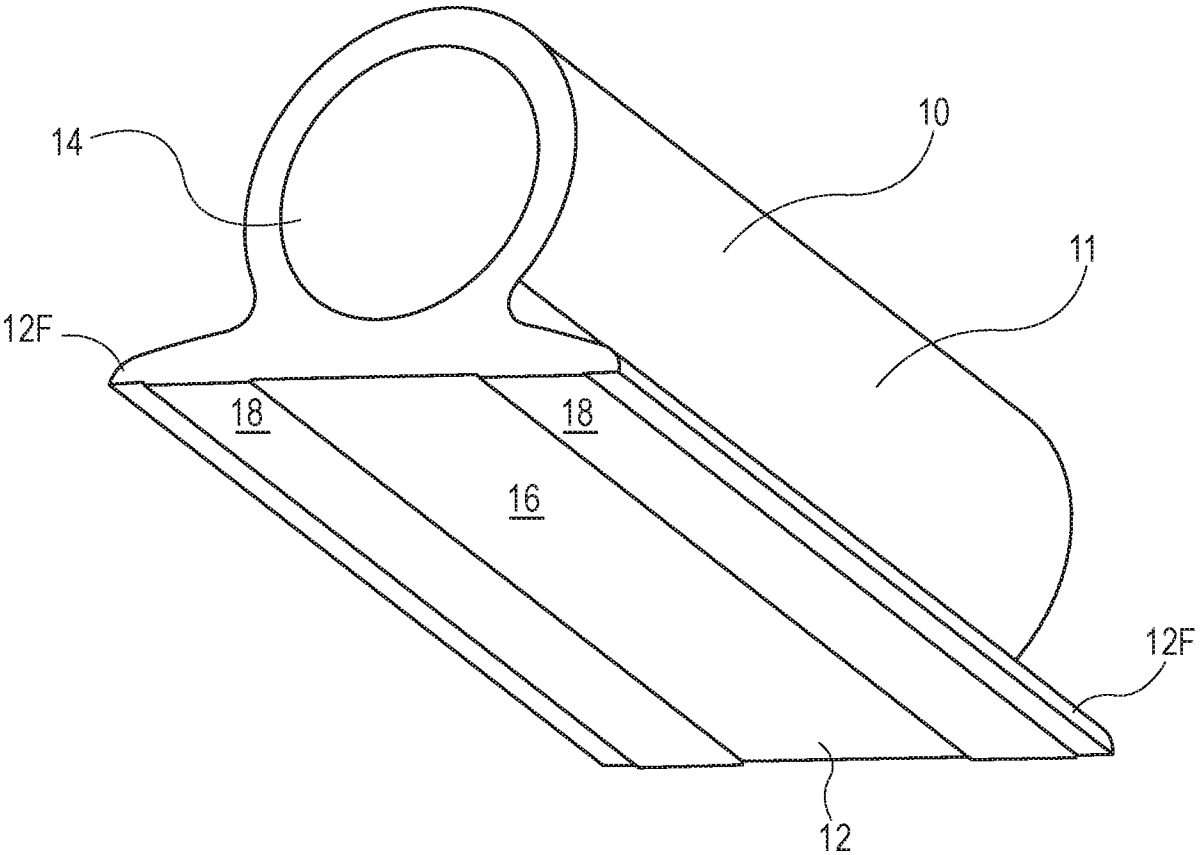
FIG. 5 is a bottom perspective view of the device of FIG. 4.
Figure 6:
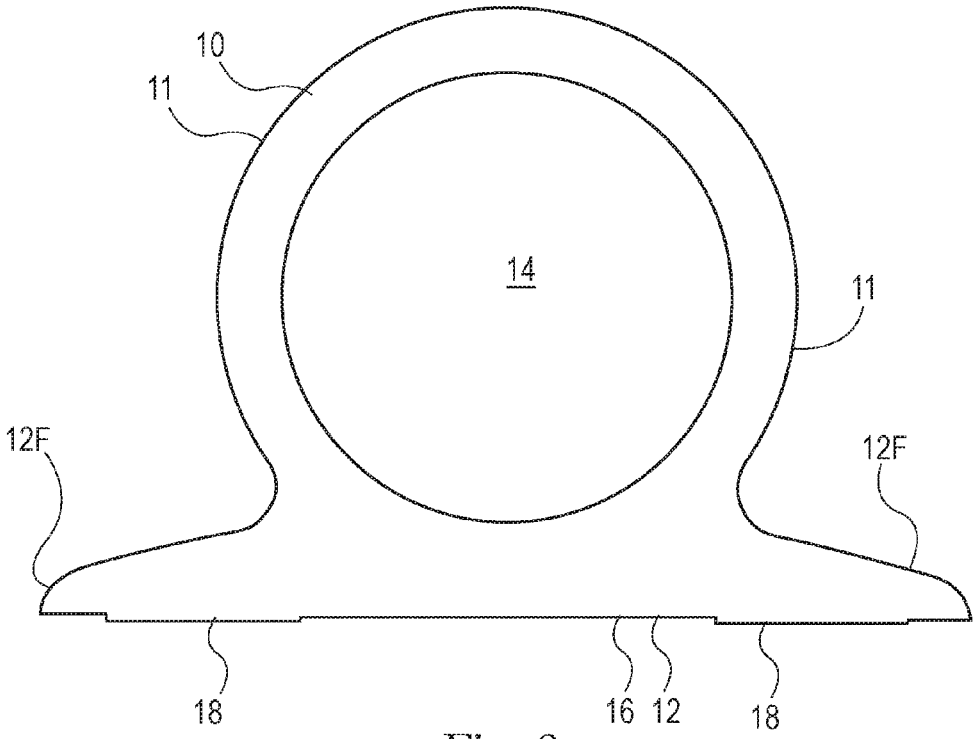
FIG. 6 is a frontal view of the device of FIGS. 4-5.

Referring to FIGS. 4-6, the sole plate 12 may have a first side facing towards the tubular block which forms the handle 11 and a second side opposed thereto which has the attachments 18 and receives the pad 30. The sole plate 12 may have a periphery which comprises a flange 12F, which defines the perimeter of the sole plate 12. The flange 12F provides a cantilevered portion of the periphery of the sole plate 12 which is easily deformable to reach into corners and conform to various irregularities in the target surface. The flange 12F may be tapered to become thinner, and more compliant at the edge. Deformation of the flange 12F particularly allows the sole plate 12, and any pad 30 attached thereto to reach corners and other undulations.

Figure 7:
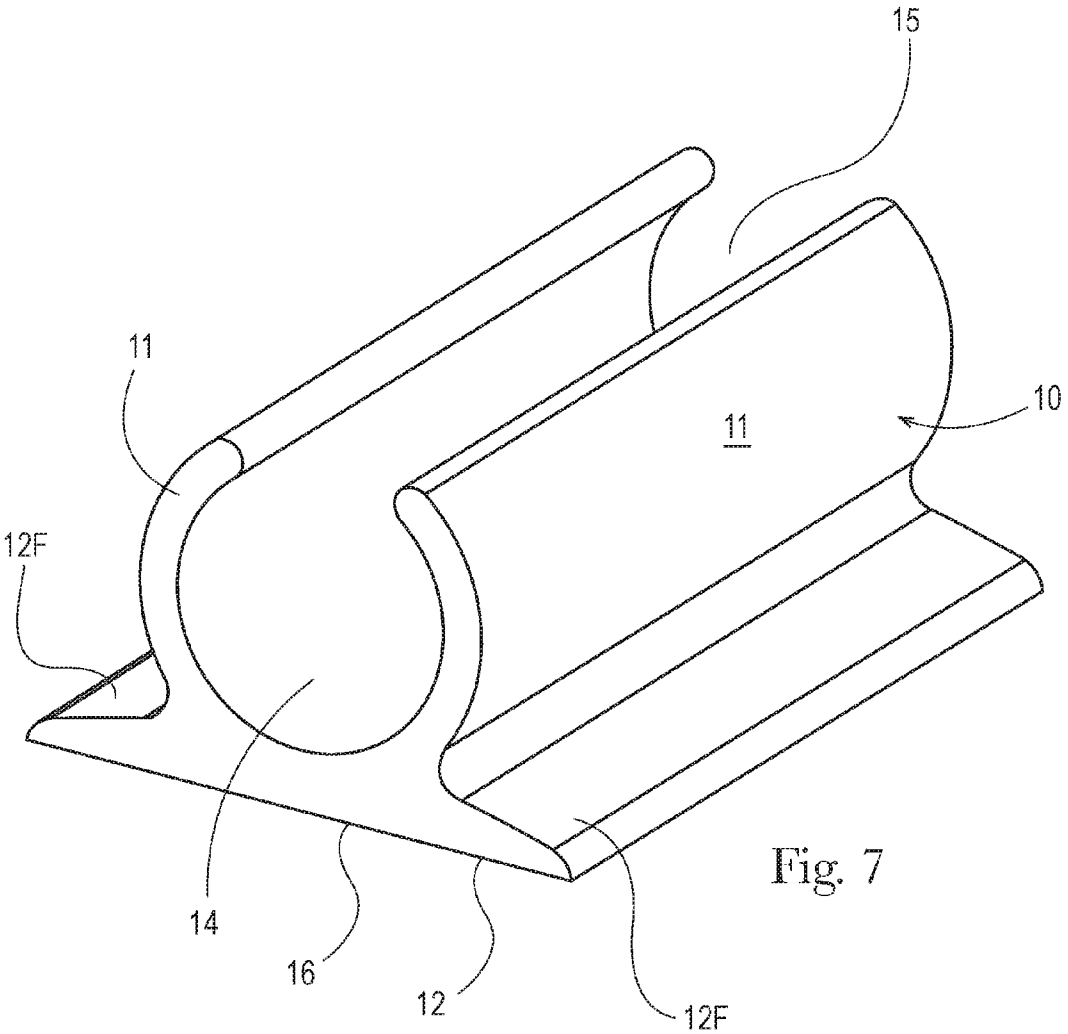
FIG. 7 is top perspective view of a second alternative embodiment cleaning device.
Figure 8:
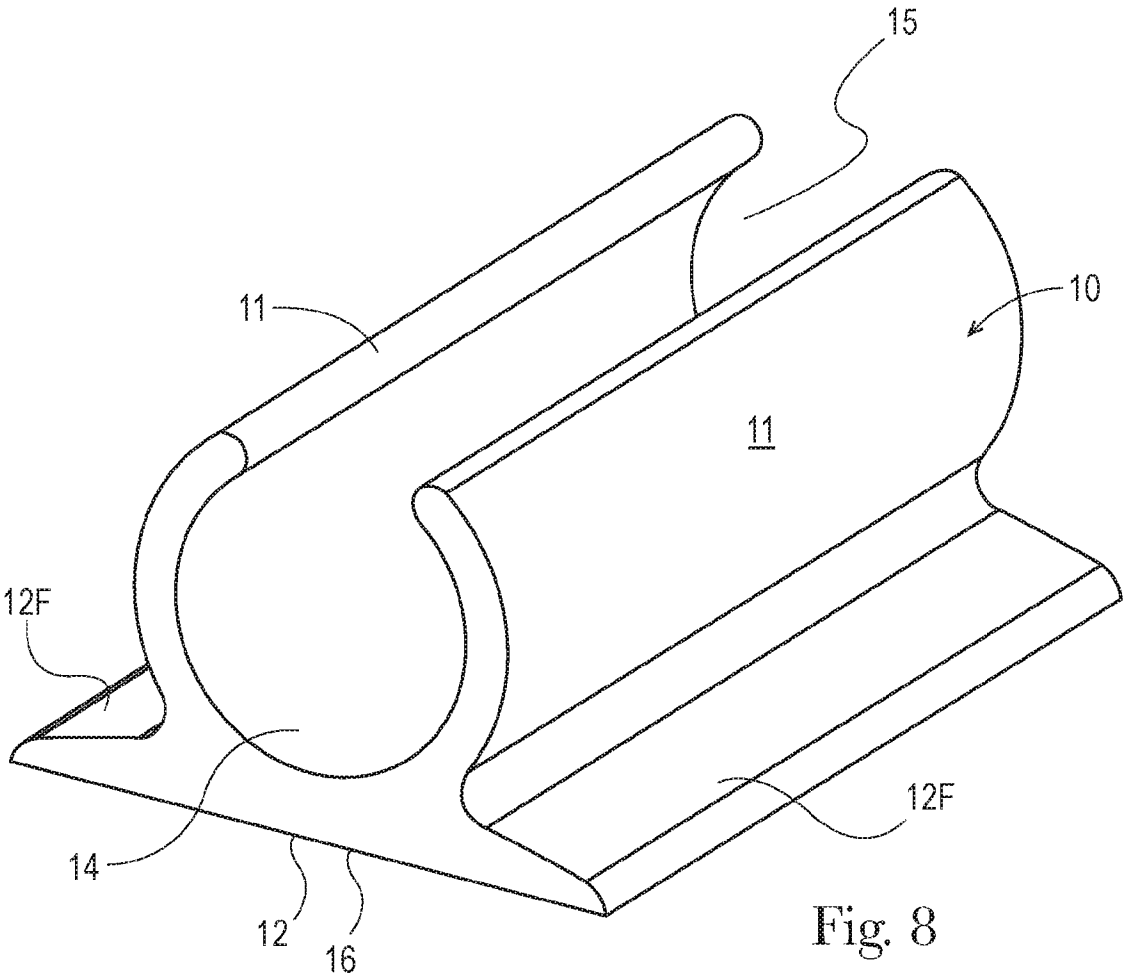
FIG. 8 is an alternative perspective view of the device of FIG. 7.

Referring to FIGS. 7-8 the top of the device 10 may partially or entirely open throughout the longitudinal direction as occurs with a longitudinal slot 15. This geometry provides the benefit that the sides of the device 10 may flex during insertion/removal of the container 22 through the slot 15. Thus, the container 22 may be inserted through the top of the device 10 if the material has sufficient compliance. Or a stiffer material may be selected using the open top configuration with a slot 15.

While a slot 15 in the top of the device 10 and symmetric about the vertical plane is shown, one of skill will recognize the invention is not so limited. The slot 15 may be offset relative to either side of the device 10, providing asymmetry. The slot 15 may be a simple knife slit or subtend almost 180 degrees, with an included angle, as measured from the longitudinal axis of 30 to 120 degrees believed suitable.

While a slot 15 of constant width is shown, one of skill will recognize the invention is not so limited. The slot 15 may monotonically converge towards the front or back of the device 10, have scalloped edges, etc.

The device 10 is shown to be elongate in the longitudinal direction, as measured by the sole plate 12. This geometry is believed to accommodate a similarly longitudinally elongate container 22, allowing for capacity. But one of skill will recognize the sole plate 12 may have a more square aspect ratio, as well as a round, oval or other shaped footprint. The hole 14 may be a through hole, as shown, or a blind hole. The hole 14 may be of constant cross section, or may have an hourglass or monotonically tapered shape to provide for advantageous frictional gripping of a container 22 inserted therein without requiring additional gripping means or components and the attendant expense/complexity. The convex shape provides a natural grip for the user, advantageously preventing the need for additional gripping components.

The hole 14, may be generally tubular, to removably receive a generally elongate container 22. While a round hole 14 and round container 22 are shown, the invention is not so limited. Any cross section of hole 14 and container 22 may be selected, so that they are complementary and fit together without requiring additional means to hold the container 22 in place during use.

Motive force for spraying the cleaning solution from the container 22 may alternatively be provided by a manual actuator, such as a trigger sprayer, as is known in the art. Alternatively, the cleaning solution may be sprayed from a container 22 having a manually operated positive displacement pump, such as a peristolic pump, piston pump a gear pump, diaphragm pump, etc. or the pump may be driven by a motor, such as a battery powered DC motor.

If desired, the device 10 may have plural holes 14, each preferably parallel to the longitudinal centerline L-L. Each such hole 14 may be used to hold a different container 22 of cleaning solution, so that a particular cleaning solution may be conveniently selected for the particular cleaning task.

If desired, the front of the device 10 may be pointed. This geometry allows for cleaning in corners and narrow spaces, as desired.

The device 10 according to the present invention, cleaning solution/container 22 and replaceable pad 30 may be sold in a kit form. One or more supplies of cleaning solution may be included in the kit form. The supplies of the cleaning solution may be mutually identical or may be different, allowing for customizing the cleaning solution choice for a particular task. Likewise, the kit may include one or more replaceable pads 30 which may be mutually identical or may be different, allowing for customizing the pad 30 choice for a particular task.

The device 10, pad 30 and/or refill container 22 may optionally comprise indicia. The indicia may comprise instructions for use, trademarks, or any other information/aesthetics considered desirable in use.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A device for cleaning a target surface and having a longitudinal axis, said device comprising:

a monolithic block of compliant material, said monolithic block having an elongate tubular hole for removably receiving a container of cleanser therein so that cleanser may be dispensed from said container without obstruction by said block, and having a generally flat sole plate suitable for removably receiving a cleaning pad thereon said device further comprising a container of cleanser disposed in said hole.

2. A device according to claim 1 wherein said tubular hole is round.

3. A device according to claim 1 wherein said tubular opening has a tube length and said sole plate has a sole plate length, said tube length being less than or equal to said sole plate length.

4. A device according to claim 3 wherein said tube length is equal to said sole plate length.

5. A device according to claim 1 having two longitudinally opposed ends, said longitudinally opposed ends being perpendicular to said flat sole plate.

6. A device according to claim 1 wherein said tubular hole is parallel to said flat sole plate.

7. A device for cleaning a target surface, said device comprising:

a block of resiliently deformable material defining a longitudinal axis, said block having an elongate tubular hole for removably receiving a container of cleanser therein, and an elongate, generally flat sole plate suitable for receiving a cleaning pad thereon, said device further comprising a container of cleanser disposed in said hole.

8. A device according to claim 7 wherein said hole subtends a closed arc of 360 degrees.

9. A device according to claim 7 having a top portion remotely disposed from said sole plate and further comprising an elongate open slot disposed at said top portion.

10. A device according to claim 9 wherein said elongate slot subtends an arc of 30 to 120 degrees.

11. A device according to claim 7 wherein said sole plate comprises two opposed flanges, said flanges being cantilevered transversely outwardly from said longitudinal axis in two opposed transverse directions.

12. A device according to claim 11 wherein each said cantilevered flange is tapered from a proximal end to a distal end remote therefrom.

13. A device according to claim 11 further comprising hooks permanently disposed on the bottom of said sole plate for removably receiving a cleaning pad thereon.

14. A device according to claim 7 wherein said sole plate is flat.

15. A longitudinally elongate device for cleaning a target surface, said device comprising:

an elongate integral extrusion, said extrusion having an elongate hole for removably receiving a container of cleanser therein so that cleanser may be dispensed from said container without obstruction by said device, and a sole plate for receiving a cleaning pad thereon, and further comprising at least one attachment on said sole plate for removably attaching a cleaning pad thereto, said attachment being selected from the group consisting essentially of hooks, loops, adhesive and combinations thereof, said device further comprising a container of cleanser disposed in said hole.

16. A device according to claim 15 wherein said extrusion comprises closed cell foam.

17. A device according to claim 16 wherein said extrusion consists of polyethylene foam.

18. A device according to claim 17 wherein said foam has a hardness of Shore OO 35-55.

19. A device according to claim 15 further comprising a pad disposed on said sole plate.

* * * * *